United States Patent [19]

Mettenbrink

[11] Patent Number: 4,903,867

[45] Date of Patent: Feb. 27, 1990

[54] DISPENSER FOR PASTY COMPOSITIONS

[75] Inventor: Herbert Mettenbrink, Lohne, Fed. Rep. of Germany

[73] Assignee: Bramlage Gesellschaft mit beschränkter Haftung, Lohne/Oldenburg, Fed. Rep. of Germany

[21] Appl. No.: 219,804

[22] Filed: Jul. 15, 1988

Related U.S. Application Data

[63] Continuation-in-part of Ser. No. 28,063, Mar. 19, 1987, abandoned, which is a continuation of Ser. No. 787,941, Oct. 16, 1985, abandoned.

[30] Foreign Application Priority Data

Oct. 20, 1984 [DE] Fed. Rep. of Germany ..... 3438579

[51] Int. Cl.[4] ..... B65D 37/00

[52] U.S. Cl. ..... 222/207; 222/209; 222/213; 222/357; 222/494

[58] Field of Search ..... 222/129, 207, 209, 212, 222/213, 387, 491, 494

[56] References Cited

U.S. PATENT DOCUMENTS

| | | | |
|---|---|---|---|
| 3,300,106 | 1/1967 | Chmela | 222/517 |
| 3,768,705 | 10/1973 | Spatz | 222/213 |
| 3,833,154 | 9/1974 | Markowitz | 222/212 |
| 4,154,371 | 5/1979 | Kolaczinski et al. | 222/386 X |
| 4,236,656 | 12/1980 | Perrella | 222/517 |
| 4,394,939 | 7/1983 | Thor et al. | 222/494 X |
| 4,413,759 | 11/1983 | Mettenbrink | 222/213 |
| 4,438,871 | 3/1984 | Eckert | 222/494 X |
| 4,474,313 | 10/1984 | Sieverding | 222/211 |
| 4,511,068 | 4/1985 | Bossina | 222/387 X |
| 4,538,747 | 9/1985 | von Schuckmann | 222/387 X |
| 4,545,510 | 10/1985 | Mettenbrink | 222/209 |

FOREIGN PATENT DOCUMENTS

| | | | |
|---|---|---|---|
| 2901717 | 7/1980 | Fed. Rep. of Germany | 222/387 |
| 1118446 | 7/1968 | United Kingdom | 222/494 |
| 2083142 | 3/1982 | United Kingdom | 222/209 |

*Primary Examiner*—Joseph J. Rolla
*Assistant Examiner*—Mona C. Beegle
*Attorney, Agent, or Firm*—Martin A. Farber

[57] ABSTRACT

Dispensers for pasty compositions having a housing (1) with a piston (2) which is displaceable only in the emptying direction and an actuating handle (H) which is developed on a head piece (5) which can be pressed bellows-like in the direction towards the piston (2) and has a dispenser outlet opening (Ö) from which there extends, directed inwards, a tube (7) whose inner mouth-end (7″) dips freely into the pasty composition in every position of the bellows (B). A structural shape which is simple to manufacture and nevertheless dependable in operation, comprises a flap valve (9) with passage opening lying in the direction of the tube (7) (arrow z), below the inner mouth-end (7″) of the tube (7), in the cover (8) of the housing (1) from which a mounting collar (6) for the bellows (B) extends.

13 Claims, 3 Drawing Sheets

DISPENSER FOR PASTY COMPOSITIONS

RELATED APPLICATION:

This application is a continuation-in-part of my copending application Ser. No. 028,063 Filed: March 19, 1987 (now abandoned) which in turn is a continuation of my pending application Ser. No. 787 941 Filed: October 16, 1985 (now abandoned).

FIELD AND BACKGROUND OF THE INVENTION

The present invention refers to a dispenser for pasty compositions, having a housing containing a piston which is displaceable only in the emptying direction and an actuating handle on the outside which is developed on a head piece which can be compressed bellows-like in the direction towards the piston, said head piece having a dispenser outlet opening from which there extends, directed inwards, a small tube, the inner mouth-end of which extends freely into the pasty composition in every position of the bellows.

A dispenser of this kind is known from Federal Republic of Germany OS 30 42 285. The pasty composition present in the small tube exerts a valve function. The pulling of the piston over the column of filling material is effected by way of priority, i.e. before the residual amount in the small tube which acts in blocking fashion and in plug-like manner could compensate for the existing vacuum by air. The blocking of the piston in the other direction is effected by use of a so-called clamping module. The latter is placed on the wide surface of the piston facing the stand-side end of the housing; it is a multi-pointed star-shaped structural part of spring steel. The diameter circumscribing the ends of the points is greater than the inside diameter of the housing so that the ends of the points hook themselves as oblique supporting feet on the inner wall of the housing. Such a structural part is relatively expensive for a throw-away mass-produced article. Also an additional mounting step results. In addition to this, relatively high frictional forces must be overcome, as a result of which certain limits are established with respect to the viscosity.

The object of the present invention is so to develop a dispenser of this type in a form which is simple to manufacture and stable in use that the one-sided displacement of the piston is effected without structural parts on the piston.

SUMMARY OF THE INVENTION

According to the invention below the inner mouth-end (7″) of the tube (7) there is present in the cover (8) of the housing (1) from which a mounting collar (6) for the bellows (B) extends, a flap valve (9) with passage opening (10) lying in the direction of the tube (arrow z).

As a result of this development the relatively expensive clamping module can be dispensed with. Nevertheless, the customary reliability in use is retained. The structural means are simple since a flap valve with passage opening lying in the direction of the small tube is located below the inner mouth-end of the small tube within the cover of the housing from which cover an attachment collar for the bellows extends. Such a flap valve can be formed directly on the functional part in simple manner. A high degree of economy is present. Furthermore, considerably less frictional forces occur on the piston, which further adds to the reliability of operation and, in addition, permits the use of a wide range of viscosities for the filling material. Pressure is produced only on the valve flap and no longer on the piston. It is furthermore advantageous, in accordance with the invention, that the section of the inner mouth-end of the small tube overlaps the attachment collar. On the one hand, the maximum length of the inside of the bellows is utilized for the tube while, on the other hand, a certain actuating end-stop for the bellows results from this arrangement via the tube. Substantially loss-free dispensing can be obtained by simple means in the manner that on its upper side the piston forms a flat wall extending parallel to the housing cover which centrally bears the valve flap. In this connection, the top advisedly terminates with one of the customary edge lips of the piston. With regard to the development of the flap valve preferably the valve flap is formed on the housing cover, peripherally and of the same material, over a thinned cross section which has an initial tension inherent in it as a result of the injection moulding of the valve flap in housing inwardly-directed, perpendicular position and by threading through the passage opening. Thus, the valve flap is always reliably urged into closing position solely by the restoring force which is inherent in the material. In addition, there is also the weight itself, even though slight, of the valve flap, namely with due consideration of the position of use which customarily occurs. With respect to long-time storage of the dispenser, it is also beneficial that a closure stopper of the dispenser outlet opening is acted on by a part of an annular rib on the cover inner surface of a cup-shaped covering cap of round cross section. Upon placing the dispenser in use it is no longer necessary constantly to coordinate the closure stopper again with the tube since the contents of the tube cannot dry out, due to the permanent moisture connection to the remaining supply which is close to delivery, within the period of consumption which is customarily taken as a basis, particularly as the cover cap can always be coordinated again.

BRIEF DESCRIPTION OF THE DRAWINGS

The object of the invention is explained in further detail below with reference to an embodiment shown in the drawings, in which.

DETAILED DESCRIPTION OF THE PREFERRED EMBODIMENT

Figure 1:
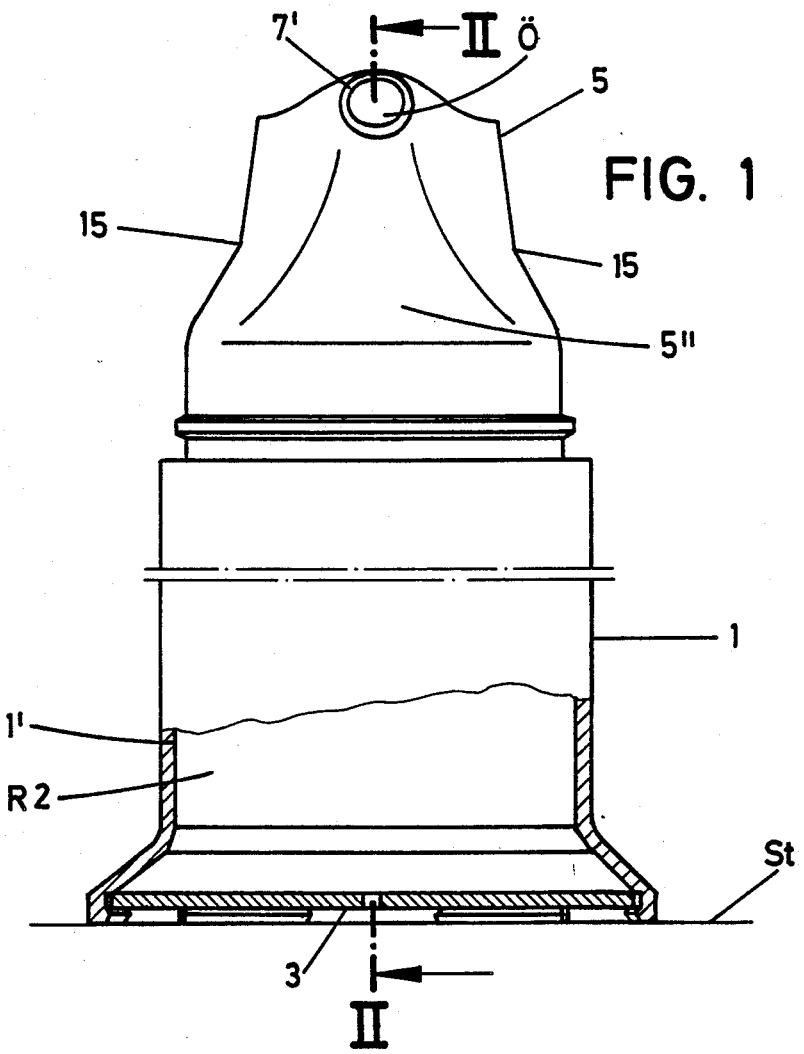
FIG. 1 is a front view of the dispenser developed in accordance with the invention, with the cover cap removed, and partially broken away.

The housing 1, which is developed as a long cylinder, contains a piston 2. The edge lips 2′ of said piston are guided on the inner wall 1′ of the cylindrical housing.

The housing 1 itself is open but can be closed by means of a bottom plate 3 which can be snapped into position.

The delivery-side closure of the housing 1 is formed by an actuating handle H which is arranged opposite the widened standing base 4 of the housing. The actuating handle is a head piece 5 which can be compressed in bellows-like manner in the direction towards the piston 2 and always comes back up again by itself into its basic position. The head piece is placed on a mounting collar 6 which is narrower than the housing 1. By means of a thread or ring and groove engagement in cooperation with the restoring force of the flexible material which forms the head piece 5 there is a connection between the two parts which is stable in use.

The head piece 5 forms a dispenser outlet opening Ö which is reduced in cross section. From said opening there extends a tube 7 which extends into the inside R 1 of the dome-shaped head piece 5. The outlet-opening end of the tube commences near the edge both in the cover 5' of the head piece 5 and also in part in the wall 5'' of the head piece. This wall 5'' is slightly wasp-shaped. The tube passes into a protuberance 7''' formed by the head piece 5 and extending somewhat beyond the cover 5. In addition to the direct development of the tube thereon by injection molding there is, of course, also the possibility of producing it as a separate structural part and holding it on the head piece 5 by welding or by gluing. As can be noted from FIG. 2, the tube 7 extends inclined at an acute angle to the longitudinal central axis y—y of the tubular or cylindrical housing 1. The angle designated alpha is about 25° . The tube can also extend parallel to the axis y—y, which would be more favorable for injection molding.

The outer mouth-end 7' of the tube which forms the outlet opening Ö extends almost up into the region of the extended cylindrical plane of the housing 1. The inner mouth-end 7'', on the other hand, points substantially into the center of a cover 8 which divides the inner space R 1 of the head piece 5 from the storage space R 2 of the housing 1. The cover extends parallel to the standing surface St and is developed on the housing 1. The distance between the inner mouth-end 7'' and the top of the cover 8 corresponds approximately to the inside diameter of the tube 7. As a result of the aforementioned inclination of the tube there is also obtained a free spacing from the inside of the mounting collar 6. The mounting collar extends from the cover 8.

The inner mouth-end section of the tube 7 overlaps the mounting collar 6. Extending into a pot-like chamber formed by the collar 6 on the cover 8.

Figure 4:
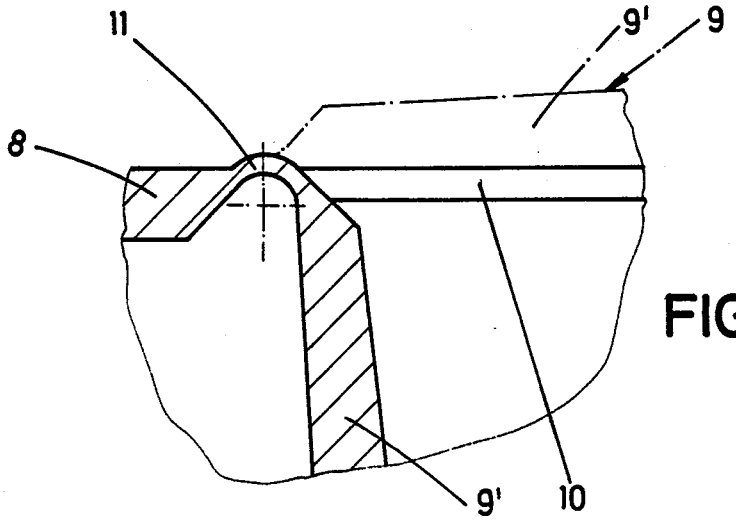
FIG. 4 is an enlarged fragmentary view of the zone of connection of the valve flap, shown in the injecting position and, in dash-dot line, in the basic position of use.

In the central region of the cover 8 there is a flap valve 9. The latter extends over the edge of its passage opening 10 in the cover 8. The contour of the flap valve 9 can be noted from FIG. 4. The contour of the passage opening is shaped accordingly. In order to keep the expense for parts low, the valve flap 9' is formed on the cover side. The hinge point is formed by a thin cross section, namely a so-called film hinge. The latter bears the reference number 11. The film hinge 11 extends over the entire width of the valve flap 9', all of the edges of which are beveled. In this way there is a thin-lipped edge which rests on the also thinned-wall edge 10' of the passage opening 10. In addition to a resting which is dependent on gravity there is also obtained a resting under spring force due to the fact that during the injection molding the valve flap 9' of the housing cover 8 is formed in a housing-inwardly-directed, perpendicular position to the standing surface St (see FIG. 4, alignment in solid lines) whereupon then, after hardening, the flexible valve flap 9' is threaded through the valve hole 10. For the formation of the initial tension 90° are used. This alignment is also favorable for the injection molding. No transverse slide need be used.

Figure 2:
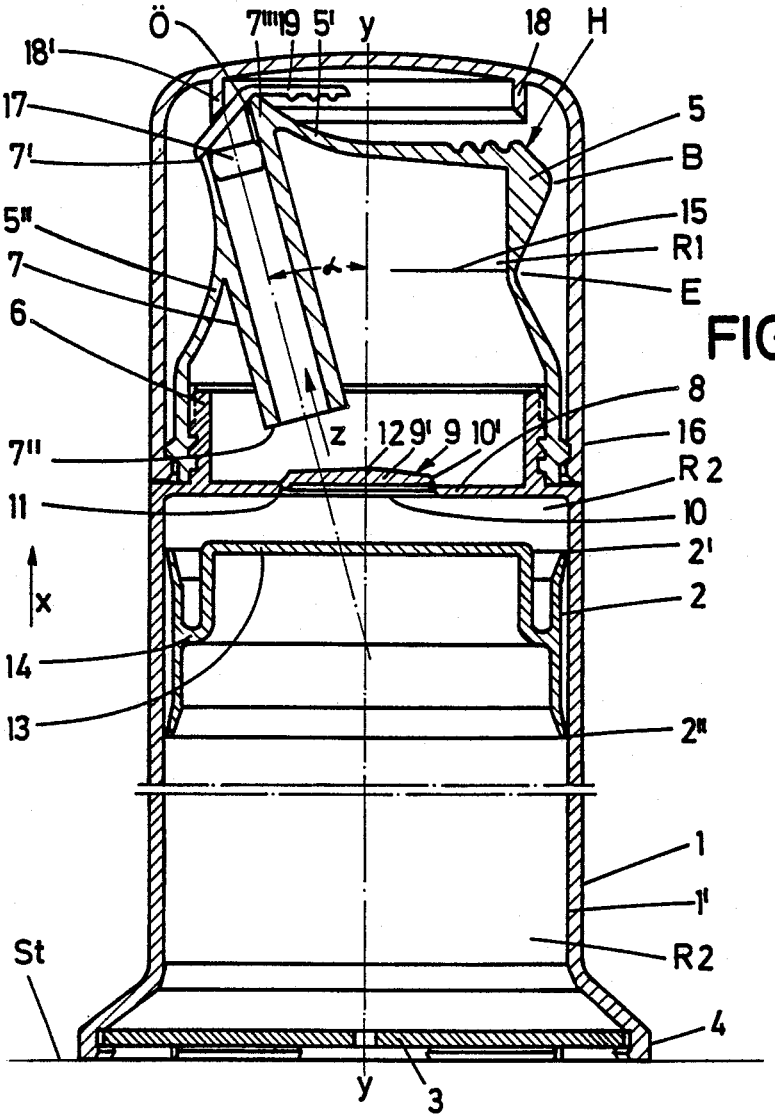
FIG. 2 is a section along the line II—II of FIG. 1.
Figure 3:
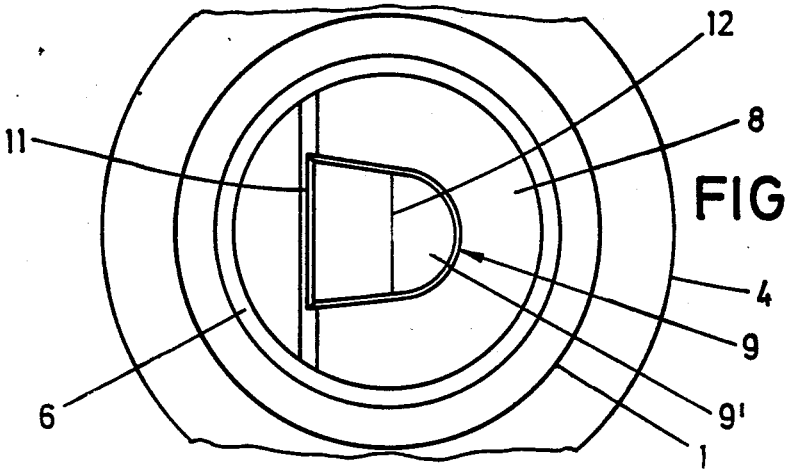
FIG. 3 is a top view of FIG. 2, but with the cover cap removed.

In order to increase the internal stability of the valve flap 9' a slightly ridge-shaped profile is selected, as can be noted from the sectional showing in FIG. 2. The ridge line 12 extends parallel to the direction of extension of the film hinge 11. The ridge line intersects the longitudinal center line y—y.

In order to obtain a dispensing which is as free of loss as possible with respect to the storage space R 2 of the container, the piston 2 forms, on its top, a flat wall 13 which extends parallel to the housing cover 8 which centrally bears the valve flap 9'. Said wall is part of a cover-side protrusion of a piston middle wall 14 which commences in the cylindrical section of the piston midway between the ring-shaped planes of the edge lips 2', 2''.

By elimination of the clamping module of the prior art, it is possible, in case of a corresponding pulling device on the piston 2, for this dispenser to be reused, i.e. to be refilled from a larger storage container. For this purpose the bottom plate 3 must first of all be removed. By corresponding beveling of the region of the housing inner wall 1' close to the bottom, the reintroduction of the piston 2 can be easily effected.

For the equalizing of air the bottom plate 3 is provided with a hole which at the same time can be used to help in removal.

The zone forming the bellows B of the head piece 5 is obtained by a horizontal constriction E of flat V shape. This constriction extends over half the cross-sectional width of the head piece 5 on the side facing away from the opening Ö. The ferrule of the bellows is designated 15 (FIG. 2).

The acute-angle coordination of the tube 7 in the part of the head piece opposite the constriction E is such that upon actuation of the bellows the tube is swung out peripherally from the region of the upward-swinging valve flap 9, which is spaced in front thereof, and tips practically into a position parallel in space to the longitudinal center axis y—y. The section of the mounting collar 6 present there can serve as stop. The film hinge is arranged at a distance corresponding to the diameter of the tube from that section of the mounting collar 6.

The head piece 5 is gripped over by a cover cap 16. The latter has an outside diameter which corresponds to that of the housing 1. In this way there is obtained a smooth continuation of the cylindrical shape up into the cap region. The cover cap 16 can be snapped on. The corresponding means are developed on its edge and cooperate with corresponding means on the edge of the head piece.

The cover cap has a further development to the effect that it cooperates in the securing of a closure stopper 17 which is inserted into the dispenser outlet opening Ö in the manner that a partial section 18' of an annular rib 18 developed on the cover inner surface of the cup-shaped cover cap acts on the back of the plug. This back is arranged obliquely and the end surface of the annular rib 18 is beveled accordingly.

The back of the stopper continues into an edge which, extending beyond the edge of the tube, passes into an inwardly-directed pull tab 19. The latter is bent at an angle and extends essentially parallel to the slightly curved cover of the cover cap which terminates in the edge regions in a stronger transverse curvature which adjoins the cylindrical outer wall of the cover cap.

The dispenser described operates in the following manner: After removal of the cover cap 16, the head piece 5 is pressed, in the region forming the bellows B which is transversely grooved or otherwise roughened on top, downwardly in the direction towards the piston 2. Pressure is produced merely on the flap valve 9. The pasty composition (not shown) present in the inner space R 1 forces its way, passing through the tube 7, as a result of the reduction of the volume within the head piece, in the direction towards the outlet opening Ö and finally emerging from the outer mouth-end 7'. If the head piece 5 is now relieved of load, a vacuum is produced in the inner space R 1. The flexible head piece 5, returning into its basic position, now pulls the piston 2 in the direction indicated by the arrow X over the column of filling material. The backward movement is at an end before the composition still remaining in the tube as a "plug" can reach or depart from the inner mouth-end 7''. The vacuum effects the swinging up of the valve flap 9' in delivery direction (arrow z) so that the flap valve 9 abuts against the inner mouth-end 7'' of said tube; the head piece 5 fills up via the passage opening 10. The spring biased valve flap 9' thereafter by its biasing moves back into its closed position. The decisive factor in all of this is that the tube 7 forms a corresponding resistance in cross section and length with adaptation to the viscosity of the pasty composition and the speed of flow which has occurred, this resistance bridging over the resultant vacuum.

Figure 6:
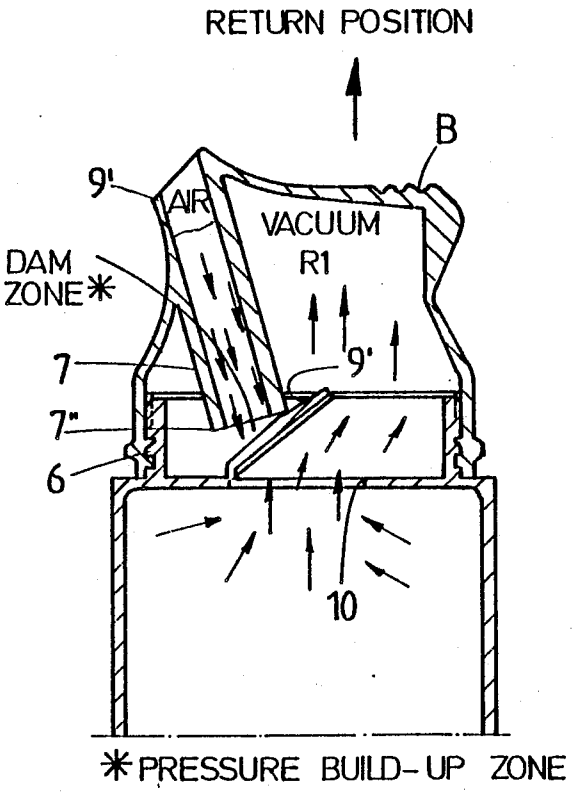
FIG. 6 is a view similar to FIG. 5 but showing the dispenser of FIG. 5 released from being pressed.
Figure 5:
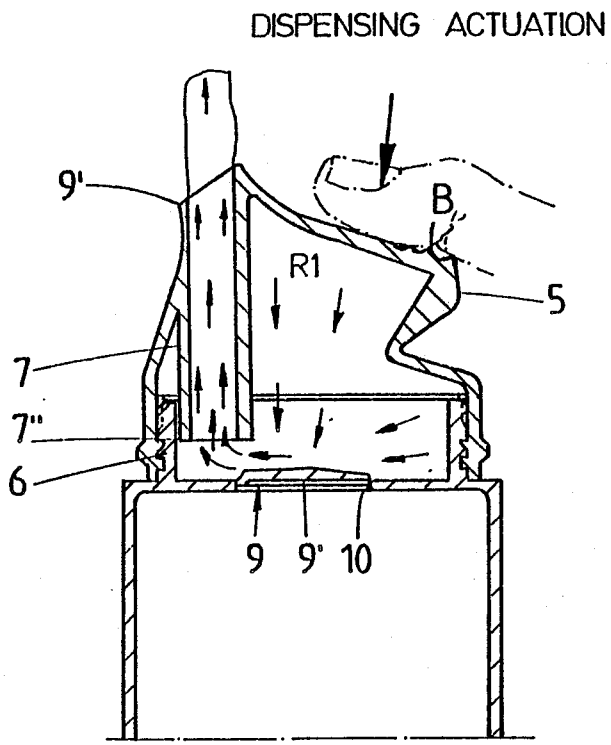
FIG. 5 is a schematic sectional view similar to FIG. 2 broken-away in part showing the dispenser in an actuation condition with the bellows being pressed by a person's finger.

The inner mouth-end 7'' of the tube 7 is spaced above said flap valve 9 by a distance substantially equal to an inner diameter of the tube (FIG. 2), the flap valve 9 having a length from the hinge 11 to its right-hand end in the drawings substantially greater than said distance. When pressing down on the bellows B as shown in FIG. 5 the flap valve 9 is further pressed down securely closing the passage opening 10 and the tube 7 swings away from the flap valve 9 (namely, the inner mouth-end 7'' of the tube 7 swinging away from the flap valve 9) and the pasty composition exits from the outer mouth-end 7' of the tube 7. When the bellows B is released of pressing by the operator's thumb being removed, the tube 7 swings back as shown in FIG. 6 and the flap valve 9 swings up due to the vacuum created in the space R 1 in the bellows and the flap valve 9 abuts against the inner mouth-end 7'' of said tube by the flap valve 9 swinging up opening the passage opening 10.

The abutment (FIG. 6) of the flap valve 9 against the tube 7 orients the flap valve 9 so it forms an acute angle with the plane of the opening 10 so that the flap valve 9 is oriented for subsequent closure of the passage opening 10 by its own spring-biasing as well as by pressing of the bellows B, said abutment also orienting the flap valve 9 for impeding a back flow of pasty composition in the tube 7 (providing a dam zone or pressure build-up zone) upon the release of pressing on the bellows B.

I claim:

1. In a dispenser for pasty compositions having a housing containing a piston which is displaceable in use only in an emptying direction, and a head piece, the latter being compressible by pressing in an actuating condition as a bellows in a direction towards the piston, said head piece having a dispenser outlet opening from which an inwardly directed tube extends the tube having an inner mouth-end extending freely into the pasty compositions in every position of the bellows, the improvement comprising a cover of the housing, a hard-walled peripheral mounting collar to which the bellows is mounted, said mounting collar extends upwardly from said cover, said collar with said cover forming a pot-like chamber, the inner mouth-end of the tube extends within an upper edge of the mounting collar, the inner mouth-end extending into the pot-like chamber, the dispenser further having only one valve, said one valve comprising a flap valve centrally disposed in said cover below the inner mouth-end of the tube in a rest condition of the dispenser, said flap valve having a passage opening, said flap valve being substantially flat such that said flap valve is located below said upper edge of the mounting collar in a position of said flap valve closing said passage opening, said cover defining a substantially flat bottom of said pot-like chamber so that the latter is a free unimpeded chamber filled with the pasty compositions into which the inner mouth-end of the tube extends, said piston forms at its top a flat-surface wall which extends parallel to the housing cover, said flap valve has a hinge connected to said cover and is disposed on said cover such that when pressing said bellows in said actuating condition said passage opening is closed, the inner mouth-end of said tube extends toward said flap valve and having an axis which intersects said flap valve substantially in a range between said hinge and a center of said cover when said bellows is not pressed, and said inner mouth-end of said tube is spaced above said flap valve by a distance substantially equal to an inner diameter of said tube, said flap valve having a length from said hinge substantially greater than said distance so as to enable abutment of said flap valve against the inner mouth-end of said tube when said bellows is released from said actuating condition, said inner mouth-end of said tube swinging away from said flap valve such that the axis of said inner mouth-end of said tube is displaced substantially from intersection with said flap valve upon pressing said bellows in said actuating condition, said abutment of the inner mouth-end of said tube and said flap valve for assisting closure of said passage opening upon a pressing of said bellows and, said abutment impeding a back flow of pasty compositions in said tube upon a release of pressure on said bellows.

2. The dispenser according to claim 1, wherein said substantially flat flap valve is thin in axial direction of the housing and has a slightly thickened ridge-shaped profile at its center.

3. The dispenser according to claim 1, whereby said flap valve is spring biased toward a position of said flap valve closing said passage opening.

4. The dispenser according to claim 1, wherein said tube is mounted on said head piece such that said tube extends downwardly axially radially inwardly inclined centrally toward said flap valve and such that said inner mouth-end of said tube adjacent said flap valve tilts radially outwardly when said bellows is pressed, said collar forming a stop for this radially outwardly tilting of said tube.

5. The dispenser according to claim 1, wherein said flap valve on only one peripheral side thereof is formed in one-piece on the housing cover via a thinned cross section constituting said hinge, said thinned cross section has an initial stress inherent therein biasing said flap valve after its opening to move back into said closed position closing said passage opening.

6. The dispenser according to claim 5, wherein said hinge is a film hinge.

7. The dispenser according to claim 5, wherein said tube is inclined relative to a longitudinal axis of said housing so that said inner mouth-end of said tube swings in a direction away from said flap valve and said hinge when pressing said bellows.

8. In a dispenser for pasty compositions having a housing containing a piston which is displaceable in use only in an emptying direction, and a head piece, the latter being compressible in an actuating condition as a bellows in a direction towards the piston, said head piece having a dispenser outlet opening from which an inwardly directed tube extends, the tube having an inner mouth-end extending freely into the pasty compositions in every position of the bellows, the improvement comprising a cover of the housing, a hard-walled peripheral mounting collar to which the bellows is mounted, said mounting collar extends upwardly from said cover, said collar with said cover forming a pot-like chamber, the inner mouth-end of the tube extends within the mounting collar, the inner mouth-end extending into the pot-like chamber, and the dispenser further having only one valve, said one valve comprising a flap valve centrally disposed in said cover below the inner mouth-end of the tube in a basic rest condition of the dispenser, said flap valve having a passage opening and a hinge, the inner mouth-end of the tube points substantially centrally to said flap valve when said bellows is not pressed, said flap valve and said cover defining a substantially flat bottom of said pot-like chamber so that the latter is a free unimpeded chamber filled with the pasty compositions into which the inner mouth-end of the tube extends, said piston forms at its top a flat-surface wall which extends parallel to the housing cover, said flap valve is disposed on said cover such that when pressing said bellows in said actuating condition said passage opening is closed, and said inner mouth-end of said tube is spaced above said flap valve by a distance substantially equal to an inner diameter of said tube, said flap valve having a length from said hinge substantially greater than said distance so as to enable abutment of said flap valve against the inner mouth-end of the tube when said bellows is released of pressing, said inner mouth-end of said tube swinging away from said flap valve such that the axis of said inner mouth-end of said tube is displaced substantially from intersection with said flap valve upon pressing said bellows in said actuating condition, said abutment of the inner mouth-end of said tube and said flap valve for assisting closure of said passage opening upon a pressing of said bellows and, said abutment impeding a back flow of pasty compositions in said tube upon a release of pressure on said bellows.

9. The dispenser according to claim 8, wherein said flap valve is thin in axial direction of the housing and has a slightly thickened ridge-shaped profile at its center.

10. The dispenser according to claim 8, whereby said flap valve is spring biased toward a position of said flap valve closing said passage opening.

11. In a dispenser for pasty compositions having a housing containing a piston which is displaceable in use only in an emptying direction, and a head piece, the latter being compressible by pressing in an actuating condition piece having a dispenser outlet opening from which an inwardly directed tube extends, the tube having an inner mouth-end extending freely into the pasty compositions in every position of the bellows, the improvement comprising a cover of the housing, a hard-walled peripheral mounting collar to which the bellows is mounted, said mounting collar extends upwardly from said cover, said collar with said cover forming a pot-like chamber, the inner mouth-end of the tube extends within an upper edge of the mounting collar, the inner mouth-end extending into the pot-like chamber, the dispenser further having only one valve, said one valve comprising a flap valve centrally disposed in said cover, said flap valve having a passage opening, an axis of the tube intersects the passage opening when said bellows is not pressed, said flap valve and said cover defining a bottom of said pot-like chamber so that the latter is a free unimpeded chamber filled with the pasty compositions into which the inner mouth-end of the tube extends, said piston forms at its top a flat-surface wall which extends parallel to the housing cover, said flap valve is disposed on said cover such that when pressing said bellows said passage opening is closed, said flap valve and cover in closed position of said passage opening being below the upper edge of said mounting collar defining said bottom as substantially flat, and said inner mouth-end of said tube is spaced above said flap valve by a distance substantially equal to an inner diameter of said tube, said flap valve having a length from said hinge substantially greater than said distance so as to enable abutment of said flap valve against said inner mouth-end of said tube when said bellows is released from said actuating condition, said inner mouth-end of said tube swinging away from said flap valve such that the axis of said inner mouth-end of said tube is displaced substantially from intersection with said flap valve upon pressing said bellows in said actuating condition, said abutment of the inner mouth-end of said tube and said flap valve for assisting closure of said passage opening upon a pressing of said bellows, said abutment impeding a back flow of pasty compositions in said tube upon a release of pressure on said bellows.

12. The dispenser according to claim 11, wherein said flat flap valve is thin in axial direction of the housing and has a slightly thickened ridge-shaped profile at its center.

13. The dispenser according to claim 11, whereby said flap valve is spring biased toward a position of said flap valve closing said passage opening.

* * * * *